US006651263B1

(12) United States Patent
Hsiao et al.

(10) Patent No.: US 6,651,263 B1
(45) Date of Patent: Nov. 25, 2003

(54) TOILET TANK HAVING A TWO-STAGE FLUSHING DEVICE

(76) Inventors: Chien-Liang Hsiao, P.O. Box 55-124, Taichung (TW); Pang-Yen Tsai, P.O. Box 55-124, Taichung (TW)

( * ) Notice: Subject to any disclaimer, the term of this patent is extended or adjusted under 35 U.S.C. 154(b) by 0 days.

(21) Appl. No.: 10/352,045

(22) Filed: Jan. 28, 2003

(51) Int. Cl.[7] ..... E03D 1/14
(52) U.S. Cl. ..... 4/326; 4/405
(58) Field of Search ..... 4/324, 325, 326, 4/405, 412

(56) References Cited

U.S. PATENT DOCUMENTS

| | | | | |
|---|---|---|---|---|
| 1,605,936 A | | 11/1926 | Haas | |
| 1,667,990 A | | 5/1928 | Rogers | |
| 2,046,888 A | | 7/1936 | Watt | |
| 2,412,738 A | | 12/1946 | Martin | |
| 2,514,062 A | | 7/1950 | Hoerig | |
| 3,795,016 A | | 3/1974 | Eastman | |
| 3,913,149 A | | 10/1975 | Brinton | |
| 4,080,668 A | | 3/1978 | Banes | |
| 4,141,092 A | | 2/1979 | Jones | |
| 4,620,331 A | | 11/1986 | Sagucio | |
| 4,829,605 A | | 5/1989 | Agostino | |
| 4,837,867 A | | 6/1989 | Miller | |
| 4,864,665 A | * | 9/1989 | Toltzman | 4/325 |
| 4,969,218 A | | 11/1990 | Comparatti | |
| 5,042,096 A | | 8/1991 | Bolli | |
| 5,121,510 A | * | 6/1992 | Ricalde Medina | 4/326 |
| 5,175,893 A | | 1/1993 | Navarrete | |
| 5,191,661 A | | 3/1993 | Chang | |
| 5,261,129 A | * | 11/1993 | Roy | 4/326 |
| 5,396,666 A | | 3/1995 | Tsai et al. | |
| 5,414,877 A | | 5/1995 | Tsai et al. | |
| 5,483,706 A | | 1/1996 | Tsai et al. | |
| 6,041,452 A | | 3/2000 | Tsai et al. | |

* cited by examiner

*Primary Examiner*—Robert M. Fetsuga

(57) ABSTRACT

A toilet tank having a two-stage flushing device includes a housing, a first water outlet tube, a second water outlet tube, a first water relief valve, a second water relief valve, and a control unit. Thus, the toilet tank can provide a two-stage flushing function, so as to regulate the water outlet rate of the toilet tank, thereby saving the resource and energy. In addition, the first handle and the second handle are operated at the same direction, so as to satisfy the user's custom and the ergonomical requirement, thereby facilitating the user operating flushing device.

20 Claims, 10 Drawing Sheets

TOILET TANK HAVING A TWO-STAGE FLUSHING DEVICE

BACKGROUND OF THE INVENTION

1. Field of the Invention

The present invention relates to a toilet tank that can provide a two-stage flushing function, so as to regulate the water outlet rate of the toilet tank, thereby saving the resource and energy.

2. Description of the Related Art

A first conventional toilet tank 1 having a two-stage flushing device in accordance with the prior art shown in FIGS. 1 and 2 comprises a handle 101, a link 102, a crossbar 103, a water relief valve 104, and a water outlet 105. When the handle 101 is pressed downward as shown in FIG. 1, the water relief valve 104 is wholly detached from the water outlet 105, thereby releasing a larger amount of water of the toilet tank 1 outward through the water outlet 105. When the handle 101 is pulled upward as shown in FIG. 2, movement of the link 102 is limited by the crossbar 103, so that the water relief valve 104 is partially detached from the water outlet 105, thereby releasing a smaller amount of water of the toilet tank 1 outward through the water outlet 105. However, the handle 101 is operated at two different directions, thereby causing inconvenience in use.

A second conventional toilet tank 2 having a two-stage flushing device in accordance with the prior art shown in FIGS. 3 and 4 comprises a higher level water outlet 201, a lower level water outlet 202, a first water relief valve 203 mounted on the higher level water outlet 201, a second water relief valve 204 mounted on the lower level water outlet 202, a handle 205, a link 206 respectively connected to the first water relief valve 203 and second water relief valve 204 by a first lift wire 208 and a second lift wire 208', and a support device 207. The second lift wire 208' reeves through a roller 2072 of the support device 207. When the handle 205 is pressed downward as shown in FIG. 3, the link 206 is moved upward to lift the first water relief valve 203 by the first lift wire 208, thereby releasing a smaller amount of water of the toilet tank 2 outward through the higher level water outlet 201. When the handle 205 is pulled upward as shown in FIG. 4, the link 206 is moved downward to lift the second water relief valve 204 by the second lift wire 208', thereby releasing a larger amount of water of the toilet tank 2 outward through the lower level water outlet 202. However, the handle 205 is operated at two different directions, thereby causing inconvenience in use.

SUMMARY OF THE INVENTION

The primary objective of the present invention is to provide a toilet tank having a two-stage flushing device, wherein the toilet tank can provide a two-stage flushing function, so as to regulate the water outlet rate of the toilet tank, thereby saving the resource and energy.

Another objective of the present invention is to provide a toilet tank having a two-stage flushing device, wherein the first handle and the second handle are operated at the same direction, so as to satisfy the user's custom and the ergonomical requirement, thereby facilitating the user operating flushing device.

A further objective of the present invention is to provide a toilet tank having a two-stage flushing device, wherein the first handle can drive the second handle to move synchronously so as to largely increase the water outlet rate, thereby enhancing the flushing efficiency.

In accordance with the present invention, there is provided a toilet tank having a two-stage flushing device, comprising a housing, a first water outlet tube, a second water outlet tube, a first water relief valve, a second water relief valve, and a control unit, wherein:

the first water outlet tube is mounted in the housing;

the second water outlet tube is mounted in the housing and has a top higher than a top of the first water outlet tube;

the first water relief valve is pivotally mounted in the housing and is detachably mounted on the top of the first water outlet tube;

the second water relief valve is pivotally mounted in the housing and is detachably mounted on the top of the second water outlet tube;

the control unit is mounted in the housing and is connected to the first water relief valve by a first lift wire and the second water relief valve by a second lift wire;

the control unit includes a connecting seat, a first handle, a first link, a second handle, and a second link, wherein:

the connecting seat is mounted on an outer side of the housing;

the first handle is rotatably mounted on the connecting seat and is provided with a shaft tube extended through the connecting seat, the shaft tube of the first handle has a distal end protruded outward from the connecting seat, the first handle is provided with a press shank;

the first link has a first end secured on the distal end of the shaft tube of the first handle, the first lift wire has a first end secured on a second end of the first link and a second end secured on a periphery of the first water relief valve;

the second handle is rotatably mounted on the first handle and is provided with a shaft tube extended through the shaft tube of the first handle, the shaft tube of the second handle has a distal end protruded outward from the shaft tube of the first handle, the second handle is provided with a press shank;

the second link has a first end secured on the distal end of the shaft tube of the second handle, the second lift wire has a first end secured on the second link and a second end secured on a periphery of the second water relief valve; and the press shank of the first handle has a bottom formed with an insertion cavity, and the press shank of the second handle is formed with a protruding block inserted into the insertion cavity of the press shank of the first handle, so that when the press shank of the first handle is pressed downward, the press shank of the second handle is moved downward with the press shank of the first handle.

Further benefits and advantages of the present invention will become apparent after a careful reading of the detailed description with appropriate reference to the accompanying drawings.

DETAILED DESCRIPTION OF THE INVENTION

Figure 1:
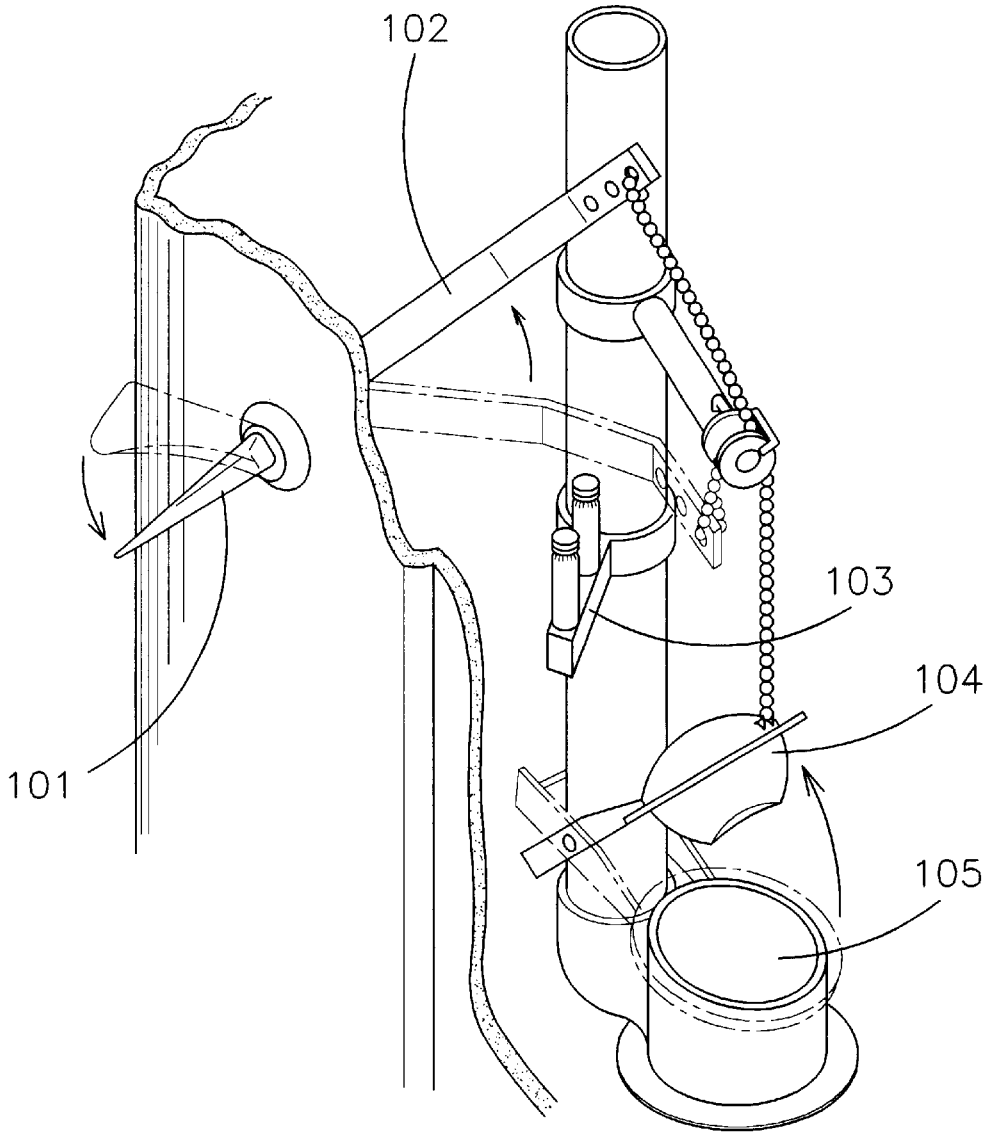
FIG. 1 PRIOR ART
FIG. 1 is a perspective operational view of a first conventional toilet tank having a two-stage flushing device in accordance with the prior art.
Figure 2:
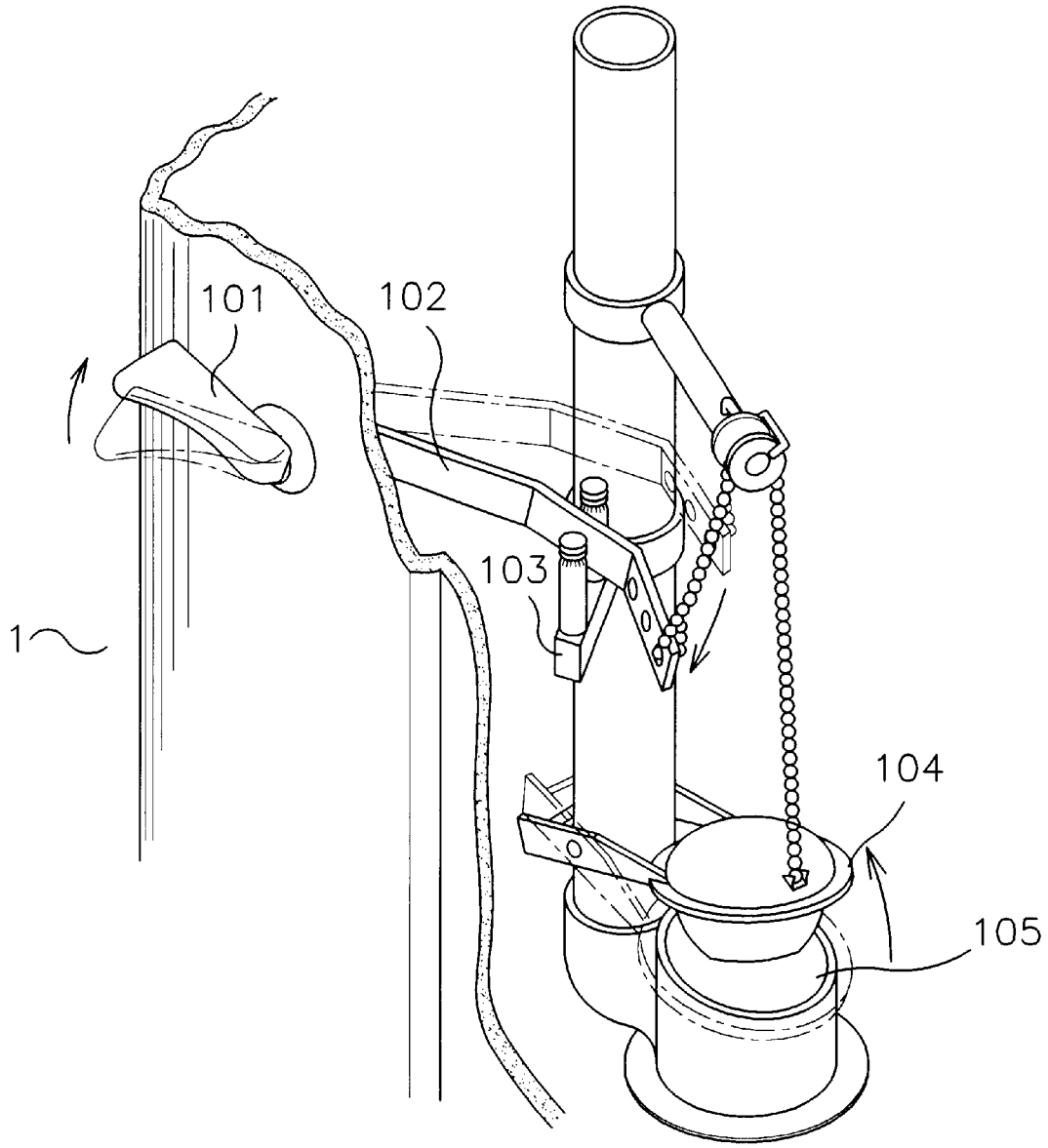
FIG. 2 PRIOR ART
FIG. 2 is a perspective operational view of the first conventional toilet tank having a two-stage flushing device in accordance with the prior art.
Figure 3:
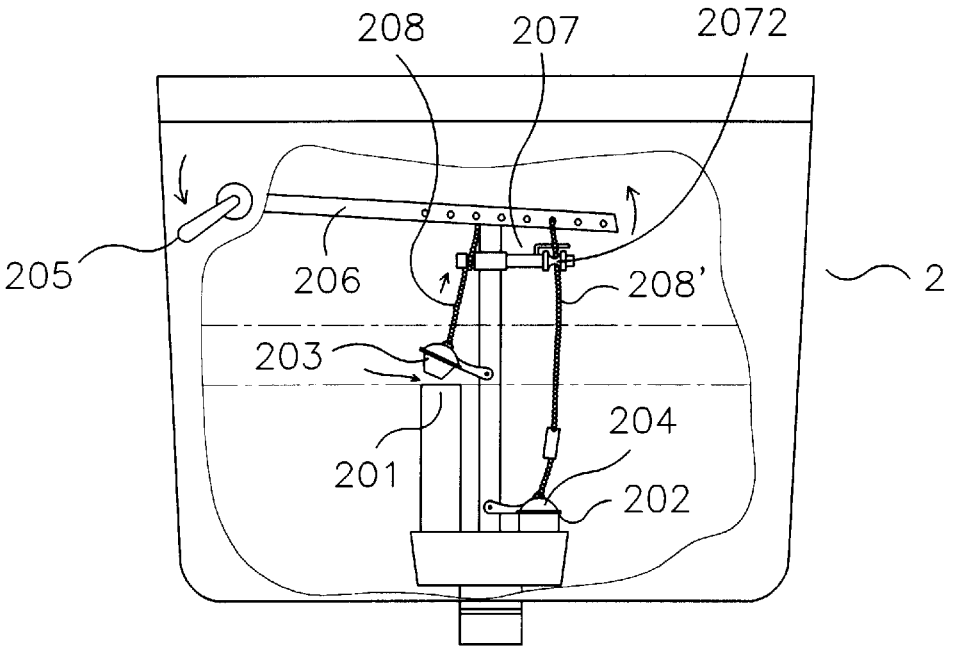
FIG. 3 PRIOR ART
FIG. 3 is a plan operational view of a second conventional toilet tank having a two-stage flushing device in accordance with the prior art.
Figure 4:
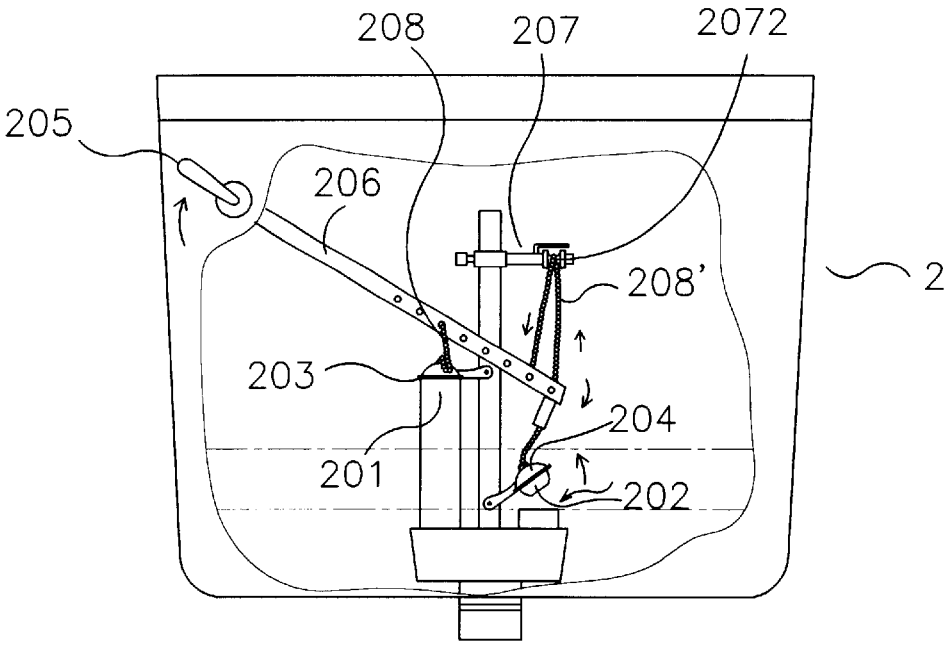
FIG. 4 PRIOR ART
FIG. 4 is a plan operational view of the second conventional toilet tank having a two-stage flushing device in accordance with the prior art.
Figure 5:
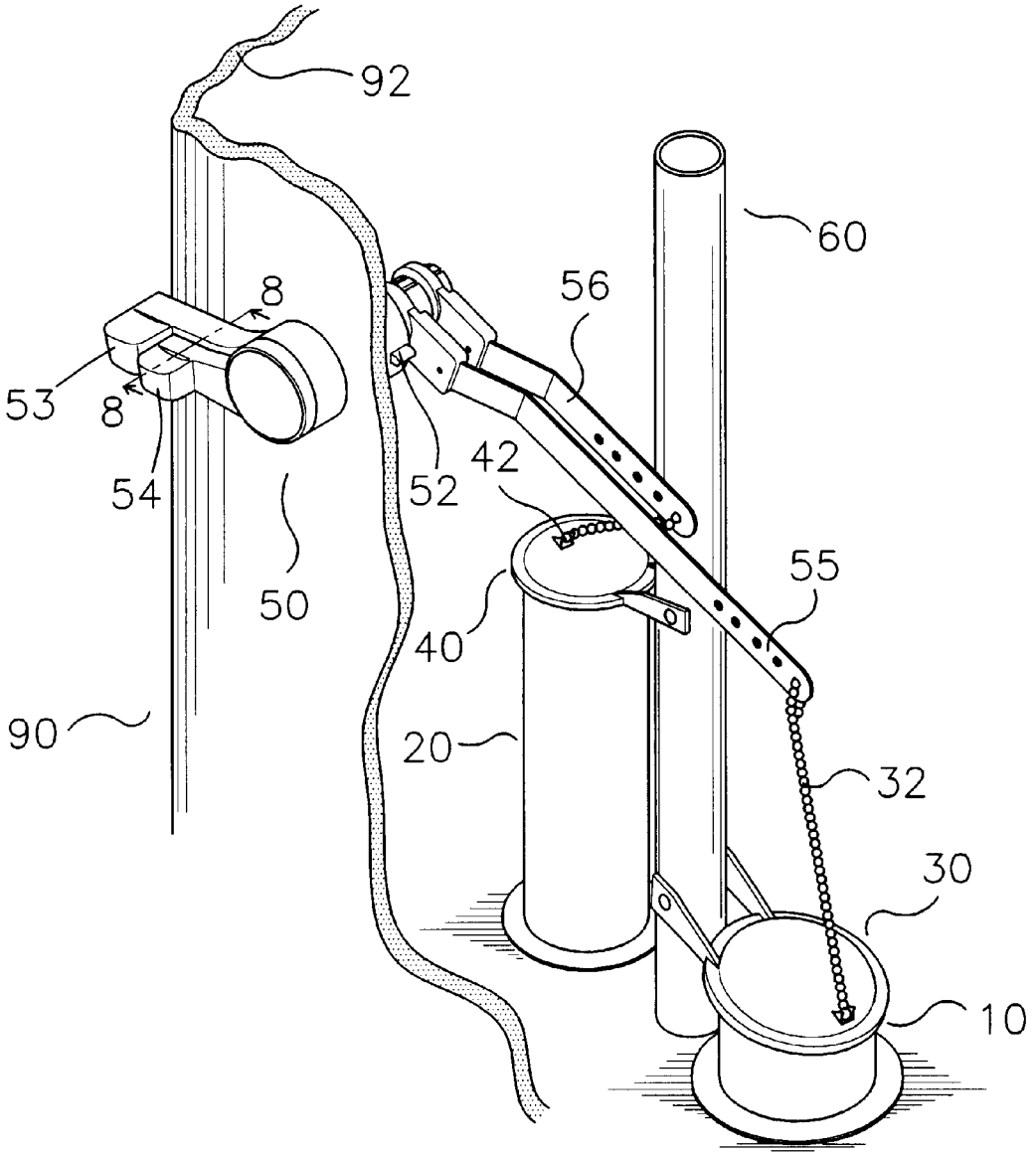
FIG. 5 is a partially cut-away perspective view of a toilet tank having a two-stage flushing device in accordance with the preferred embodiment of the present invention.
Figure 6:
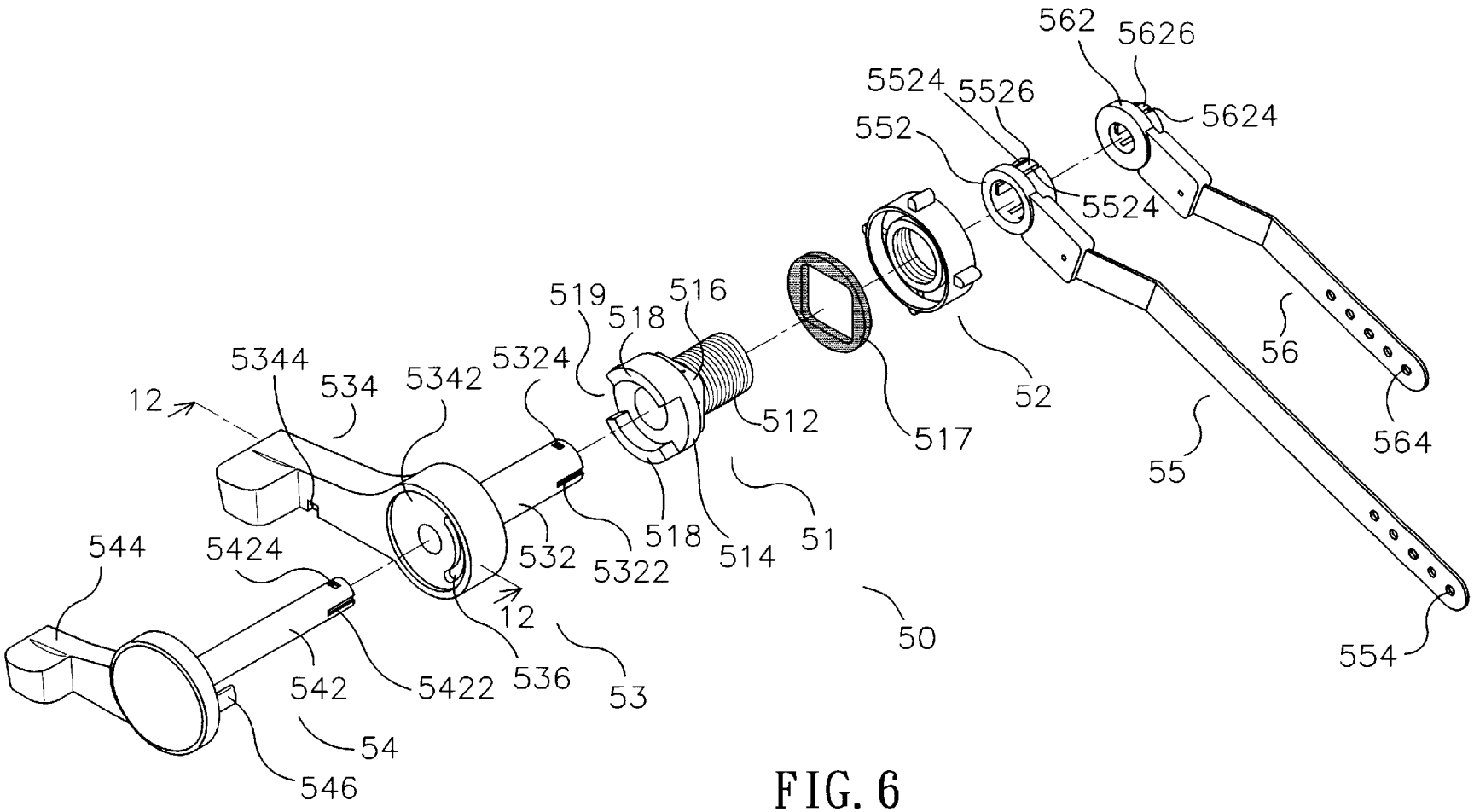
FIG. 6 is an exploded perspective view of a control unit of the toilet tank having a two-stage flushing device in accordance with the preferred embodiment of the present invention.

Referring to the drawings and initially to FIGS. 5 and 6, a toilet tank 90 having a two-stage flushing device in accordance with the preferred embodiment of the present invention comprises a housing 92, a first water outlet tube 10, a second water outlet tube 20, a first water relief valve 30, a second water relief valve 40, and a control unit 50.

The housing 92 has an inside provided with an overflow tube 60.

The first water outlet tube 10 is mounted in the housing 92 and located adjacent to the overflow tube 60.

The second water outlet tube 20 is mounted in the housing 92 and located adjacent to the overflow tube 60, and has a top higher than the top of the first water outlet tube 10.

The first water relief valve 30 is pivotally mounted on the overflow tube 60, and is detachably mounted on the top of the first water outlet tube 10.

The second water relief valve 40 is pivotally mounted on the overflow tube 60, and is detachably mounted on the top of the second water outlet tube 20.

The control unit 50 is mounted in the housing 92. The control unit 50 is connected to the first water relief valve 30 by a first lift wire 32, and is connected to the second water relief valve 40 by a second lift wire 42.

The control unit 50 includes a connecting seat 51, a locking ring 52, a first handle 53, a first link 55, a second handle 54, and a second link 56.

The connecting seat 51 is mounted on an outer side of the housing 92 and has a first end formed with a threaded tube 512 extended into the housing 92 and a second end formed with a seat disk 514 rested on the outer side of the housing 92. The connecting seat 51 has a mediate portion formed with a square shaft block 516 located between the threaded tube 512 and the seat disk 514. The connecting seat 51 includes an elastic washer 517 mounted on the shaft block 516 and rested on the seat disk 514.

The locking ring 52 is mounted on an inner side of the housing 92, and is screwed on the threaded tube 512 of the connecting seat 51, thereby securing the connecting seat 51 on the housing 92.

The first handle 53 is rotatably mounted on the seat disk 514 of the connecting seat 51, and is provided with a shaft tube 532 extended through the threaded tube 512 of the connecting seat 51. The shaft tube 532 of the first handle 53 has a distal end protruded outward from the threaded tube 512 of the connecting seat 51. The first handle 53 is provided with a press shank 534.

The first link 55 has a first end formed with a mounting ring 552 secured on the distal end of the shaft tube 532 of the first handle 53, and a second end formed with a plurality of hanging holes 554. The first lift wire 32 has a first end secured on one of the hanging holes 554 of the first link 55 and a second end secured on a periphery of the first water relief valve 30. In such a manner, when the press shank 534 of the first handle 53 is pressed, the first handle 53 is rotated to rotate the shaft tube 532 which rotate the mounting ring 552 of the first link 55, so that the first link 55 is pivoted to pull the first lift wire 32 which moves the first water relief valve 30 upward to detach from the first water outlet tube 10, thereby releasing a larger amount of water of the housing 92 outward through the first water outlet tube 10.

The second handle 54 is rotatably mounted on the first handle 53, and is provided with a shaft tube 542 extended through the shaft tube 532 of the first handle 53. The shaft tube 532 of the second handle 54 has a distal end protruded outward from the shaft tube 532 of the first handle 53. The second handle 54 is provided with a press shank 544.

The second link 56 has a first end formed with a mounting ring 562 secured on the distal end of the shaft tube 542 of the second handle 54, and a second end formed with a plurality of hanging holes 564. The second lift wire 42 has a first end secured on one of the hanging holes 564 of the second link 56 and a second end secured on a periphery of the second water relief valve 40. In such a manner, when the press shank 544 of the second handle 54 is pressed, the second handle 54 is rotated to rotate the shaft tube 542 which rotate the mounting ring 562 of the second link 56, so that the second link 56 is pivoted to pull the second lift wire 42 which moves the second water relief valve 40 upward to detach from the second water outlet tube 20, thereby releasing a smaller amount of water of the housing 92 outward through the second water outlet tube 20.

Figure 7:
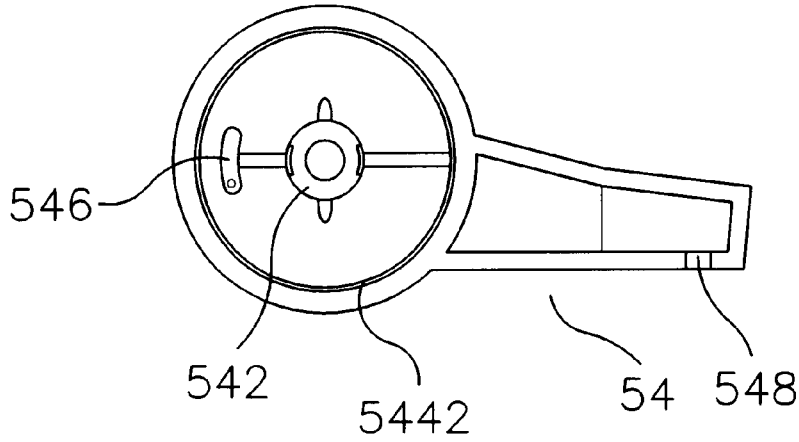
FIG. 7 is a rear plan view of a second handle of the toilet tank having a two-stage flushing device in accordance with the preferred embodiment of the present invention.
Figure 8:
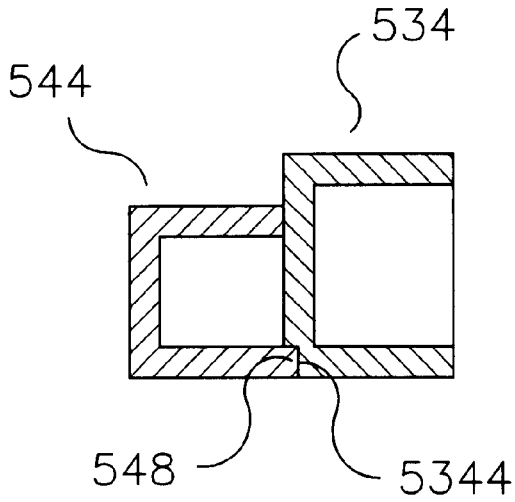
FIG. 8 is a plan cross-sectional view of the toilet tank having a two-stage flushing device taken along line 8—8 as shown in FIG. 5.

Referring to FIGS. 6–8, the first handle 53 has a first side formed with an annular groove 5342, and the second handle 54 has a side formed with an annular flange 5442 rotatably mounted in the annular groove 5342 of the first handle 53. In addition, the first side of the first handle 53 is formed with an arcuate guide slot 536, and the second handle 54 is provided with a tongue 546 movably mounted in the guide slot 536 of the first handle 53. Thus, when the second handle 54 is rotated, the tongue 546 is moved in the guide slot 536 of the first handle 53 to limit the rotation angle of the second handle 54. In addition, the press shank 534 of the first handle 53 has a bottom formed with an insertion cavity 5344, and the press shank 544 of the second handle 54 is formed with a protruding block 548 inserted into the insertion cavity 5344 of the press shank 534 of the first handle 53. Thus, when the press shank 534 of the first handle 53 is pressed downward, the press shank 544 of the second handle 54 is also moved downward with the press shank 534 of the first handle 53.

Figure 9:
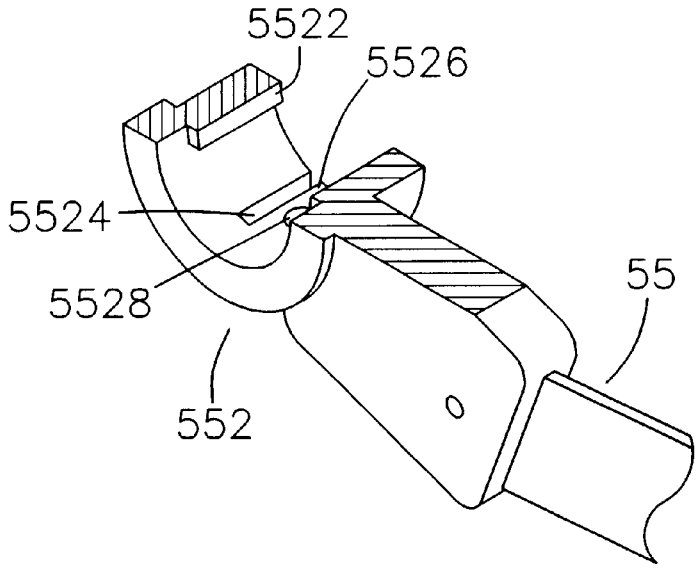
FIG. 9 is a perspective cross-sectional view of a mounting ring of a first link of the toilet tank having a two-stage flushing device in accordance with the preferred embodiment of the present invention.

Referring to FIGS. 6 and 9, the distal end of the shaft tube 532 of the first handle 53 has an outer wall formed with two opposite keyways 5322 and two opposite snap holes 5324. The mounting ring 552 of the first link 55 has an inner wall formed with two keys 5522 each inserted into a respective one of the two opposite keyways 5322 of the shaft tube 532 of the first handle 53. The inner wall of the mounting ring 552 of the first link 55 is formed with two elastic snap plates 5526 each having a distal end formed with a protruding snap boss 5528 snapped into a respective one of the two opposite snap holes 5324 of the shaft tube 532 of the first handle 53, so that the mounting ring 552 of the first link 55 is secured on the shaft tube 532 of the first handle 53. Each of the two elastic snap plates 5526 of the mounting ring 552 of the first link 55 has two sides each formed with a slits 5524.

Figure 10:
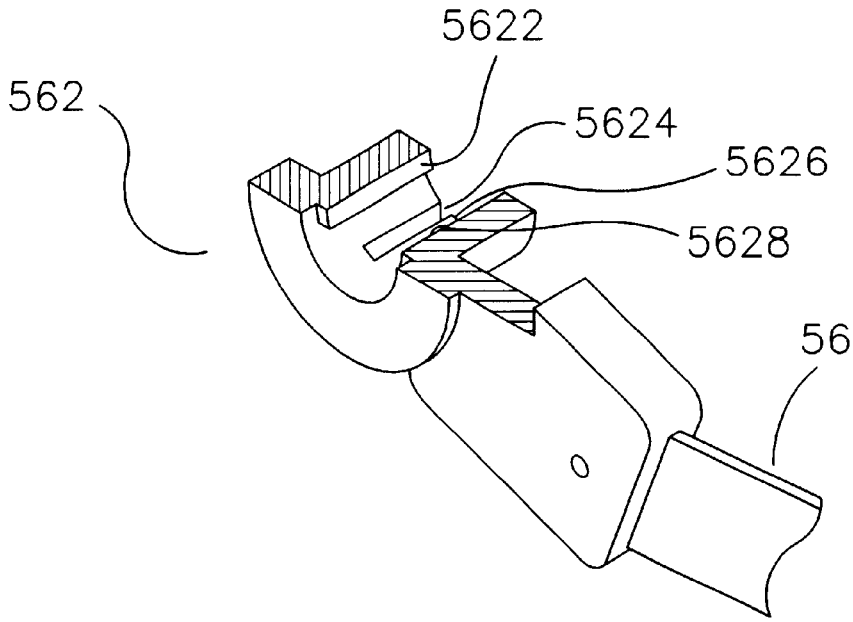
FIG. 10 is a perspective cross-sectional view of a mounting ring of a second link of the toilet tank having a two-stage flushing device in accordance with the preferred embodiment of the present invention.

Referring to FIGS. 6 and 10, the distal end of the shaft tube 542 of the second handle 54 has an outer wall formed with two opposite keyways 5422 and two opposite snap holes 5424. The mounting ring 562 of the second link 56 has an inner wall formed with two keys 5622 each inserted into a respective one of the two opposite keyways 5422 of the shaft tube 542 of the second handle 54. The inner wall of the mounting ring 562 of the second link 56 is formed with two elastic snap plates 5626 each having a distal end formed with a protruding snap boss 5628 snapped into a respective one of the two opposite snap holes 5424 of the shaft tube 542 of the second handle 54, so that the mounting ring 562 of the second link 56 is secured on the shaft tube 542 of the second handle 54. Each of the two elastic snap plates 5626 of the mounting ring 562 of the second link 56 has two sides each formed with a slits 5624.

Figure 11:
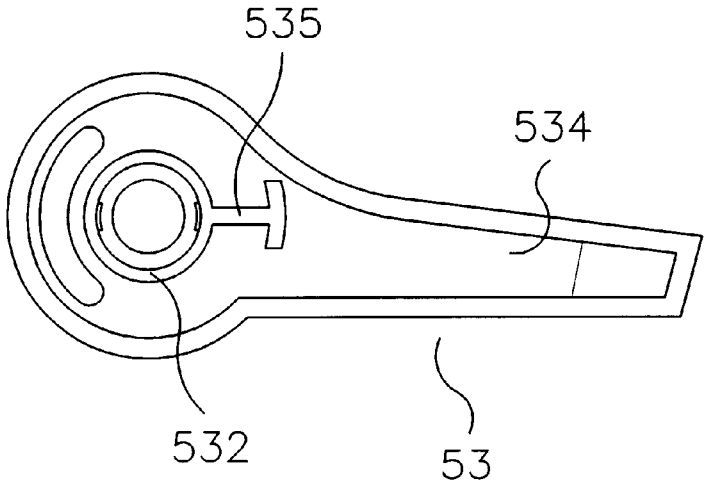
FIG. 11 is a rear plan view of a first handle of the toilet tank having a two-stage flushing device in accordance with the preferred embodiment of the present invention.
Figure 12:
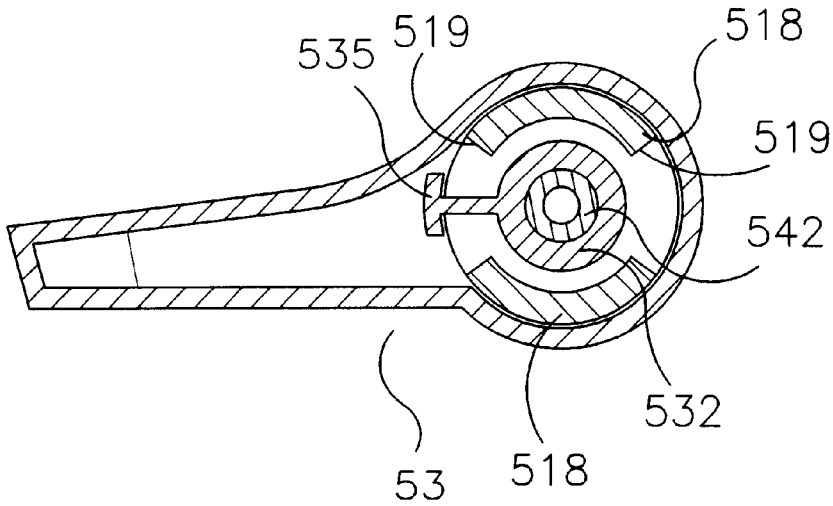
FIG. 12 is a plan cross-sectional view of the toilet tank having a two-stage flushing device taken along line 12—12 as shown in FIG. 6.

Referring to FIGS. 6, 11 and 12, the seat disk 514 of the connecting seat 51 has a periphery formed with two opposite arcuate limit blocks 518 and two opposite guide slots 519 each located between the two limit blocks 518, and the shaft tube 532 of the first handle 53 has a second side formed with a limit rib 535 movably mounted in one of the two guide slots 519 and retained by one of the two limit blocks 518 of the seat disk 514 of the connecting seat 51, so as to limit the rotation angle of the first handle 53.

Figure 13:
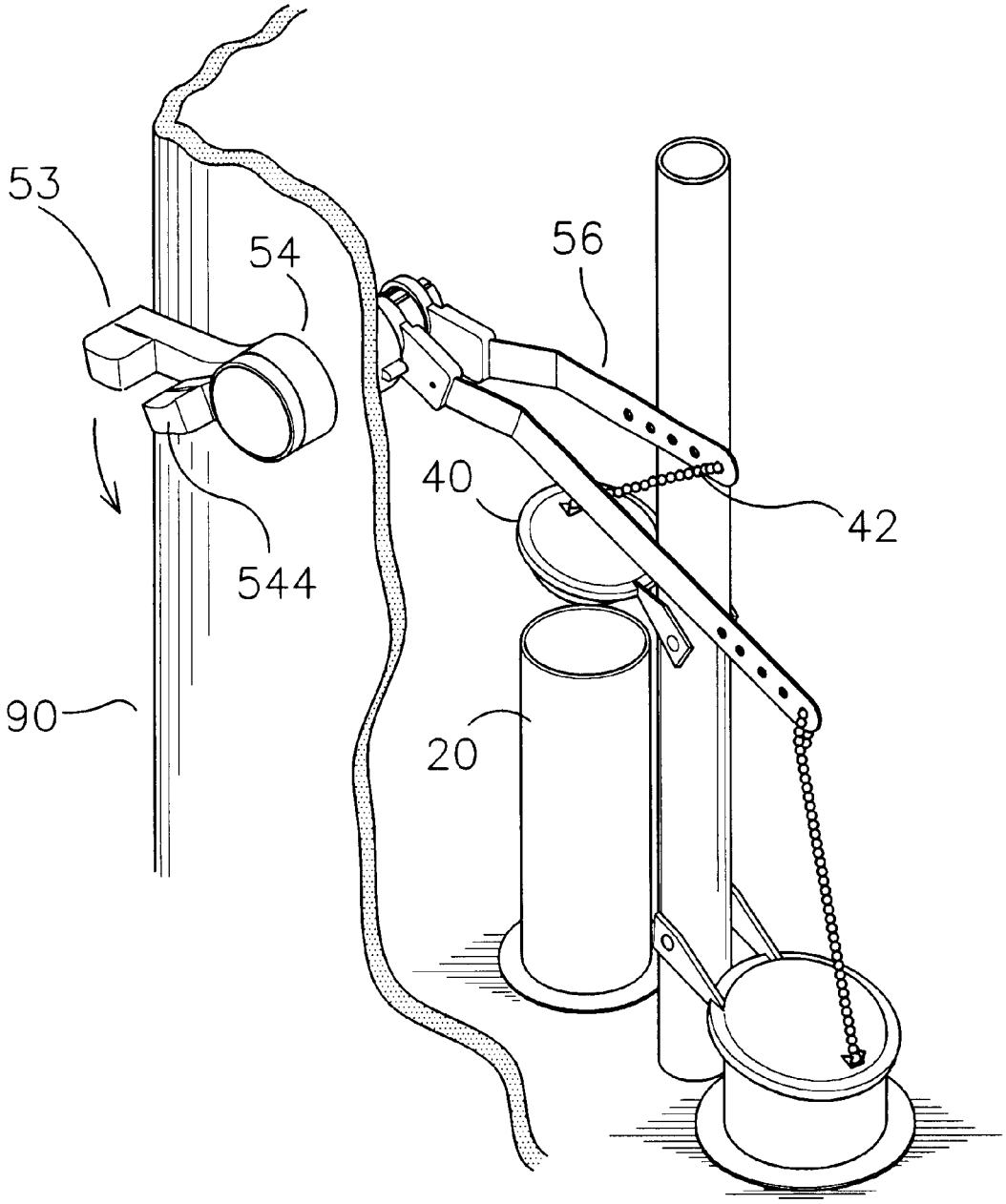
FIG. 13 is a schematic operational view of the toilet tank having a two-stage flushing device as shown in FIG. 5 in use.

In operation, referring to FIGS. 5, 6 and 13, when the press shank 544 of the second handle 54 is pressed, the second handle 54 is rotated to rotate the shaft tube 542 which rotate the mounting ring 562 of the second link 56, so that the second link 56 is pivoted to pull the second lift wire 42 which moves the second water relief valve 40 upward to detach from the second water outlet tube 20, thereby releasing a smaller amount of water of the housing 92 outward through the second water outlet tube 20.

Figure 14:
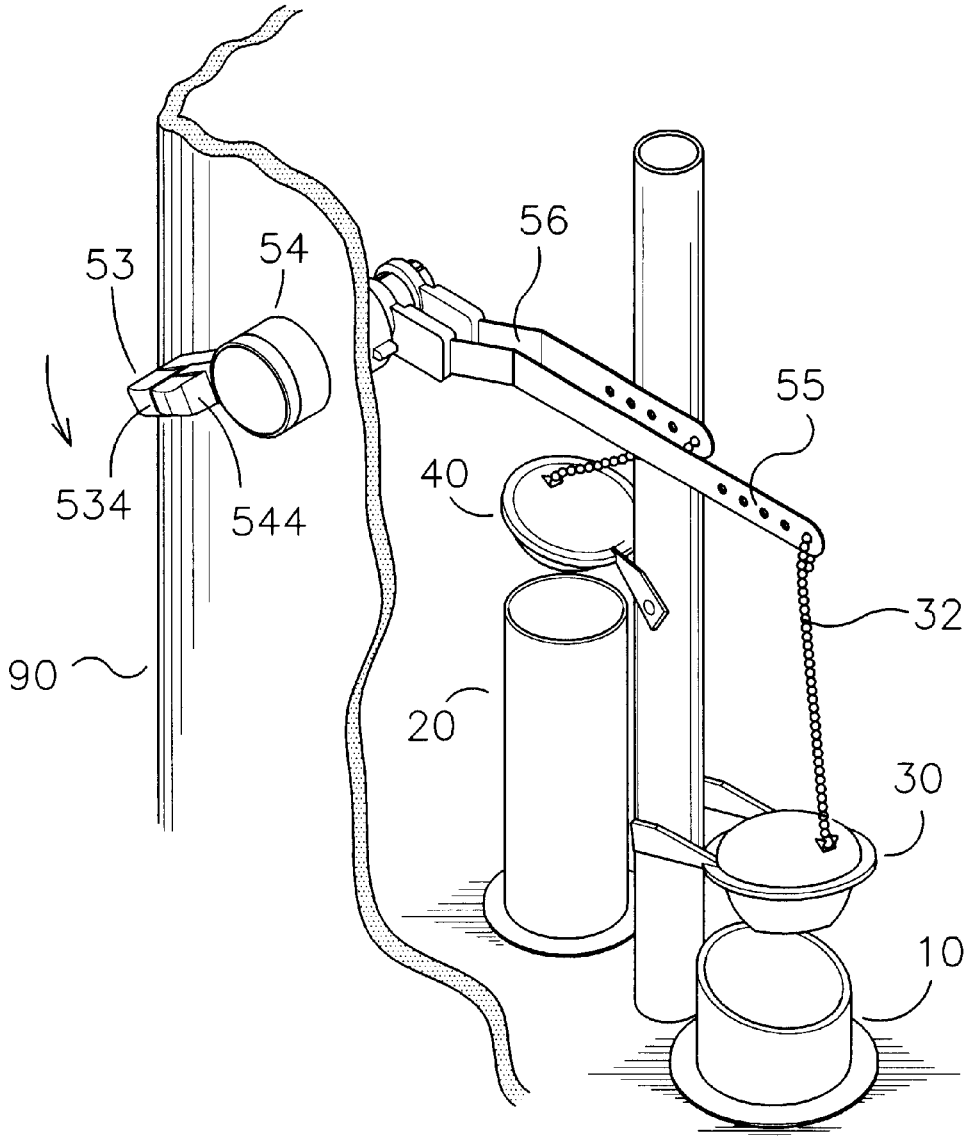
FIG. 14 is a schematic operational view of the toilet tank having a two-stage flushing device as shown in FIG. 5 in use.

Alternatively, referring to FIGS. 5, 6 and 14, when the press shank 534 of the first handle 53 is pressed, the first handle 53 is rotated to rotate the shaft tube 532 which rotate the mounting ring 552 of the first link 55, so that the first link 55 is pivoted to pull the first lift wire 32 which moves the first water relief valve 30 upward to detach from the first water outlet tube 10, thereby releasing a larger amount of water of the housing 92 outward through the first water outlet tube 10. At the same time, the press shank 544 of the second handle 54 is also pressed downward when the press shank 534 of the first handle 53 is pressed, so that the second water relief valve 40 is also pulled upward to detach from the second water outlet tube 20, thereby releasing the water of the housing 92 outward through the second water outlet tube 20.

In such a manner, when the press shank 544 of the second handle 54 is pressed, only the second water outlet tube 20 is opened, thereby releasing a smaller amount of water of the housing 92 outward through the second water outlet tube 20. Alternatively, when the press shank 534 of the first handle 53 is pressed, both of the first water outlet tube 10 and the second water outlet tube 20 are opened simultaneously, thereby releasing a larger amount of water of the housing 92 outward through the first water outlet tube 10 and the second water outlet tube 20.

Accordingly, the toilet tank 90 can provide a two-stage flushing function, so as to regulate the water outlet rate of the toilet tank 90, thereby saving the resource and energy. In addition, the first handle 53 and the second handle 54 are operated at the same direction, so as to satisfy the user's custom and the ergonomical requirement, thereby facilitating the user operating flushing device. Further, the first handle 53 can drive the second handle 54 to move synchronously so as to largely increase the water outlet rate, thereby enhancing the flushing efficiency.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A toilet tank having a two-stage flushing device, comprising a housing, a first water outlet tube, a second water outlet tube, a first water relief valve, a second water relief valve, and a control unit, wherein:

the first water outlet tube is mounted in the housing;

the second water outlet tube is mounted in the housing and has a top higher than a top of the first water outlet tube;

the first water relief valve is pivotally mounted in the housing and is detachably mounted on the top of the first water outlet tube;

the second water relief valve is pivotally mounted in the housing and is detachably mounted on the top of the second water outlet tube;

the control unit is mounted in the housing and is connected to the first water relief valve by a first lift wire and the second water relief valve by a second lift wire;

the control unit includes a connecting seat, a first handle, a first link, a second handle, and a second link, wherein:

the connecting seat is mounted on an outer side of the housing;

the first handle is rotatably mounted on the connecting seat and is provided with a shaft tube extended through the connecting seat, the shaft tube of the first handle has a distal end protruded outward from the connecting seat, the first handle is provided with a press shank;

the first link has a first end secured on the distal end of the shaft tube of the first handle, the first lift wire has a first end secured on a second end of the first link and a second end secured on a periphery of the first water relief valve;

the second handle is rotatably mounted on the first handle and is provided with a shaft tube extended through the shaft tube of the first handle, the shaft tube of the second handle has a distal end protruded outward from the shaft tube of the first handle, the second handle is provided with a press shank;

the second link has a first end secured on the distal end of the shaft tube of the second handle, the second lift wire has a first end secured on the second link and a second end secured on a periphery of the second water relief valve; and the press shank of the first handle has a bottom formed with an insertion cavity, and the press shank of the second handle is formed with a protruding block inserted into the insertion cavity of the press shank of the first handle, so that when the press shank of the first handle is pressed downward, the press shank of the second handle is moved downward with the press shank of the first handle.

2. The toilet tank having a two-stage flushing device in accordance with claim 1, wherein the first handle has a first side formed with an annular groove, and the second handle has a side formed with an annular flange rotatably mounted in the annular groove of the first handle.

3. The toilet tank having a two-stage flushing device in accordance with claim 2, wherein the first side of the first handle is formed with an arcuate guide slot, and the second handle is provided with a tongue movably mounted in the guide slot of the first handle, so that when the second handle is rotated, the tongue is moved in the guide slot of the first handle to limit a rotation angle of the second handle.

4. The toilet tank having a two-stage flushing device in accordance with claim 1, wherein the second end of the first link is formed with a plurality of hanging holes, and the first end of the first lift wire is secured on one of the hanging holes of the first link.

5. The toilet tank having a two-stage flushing device in accordance with claim 1, wherein the first end of the first link is formed with a mounting ring secured on the distal end of the shaft tube of the first handle.

6. The toilet tank having a two-stage flushing device in accordance with claim 5, wherein the distal end of the shaft tube of the first handle has an outer wall formed with two opposite keyways and two opposite snap holes, and the mounting ring of the first link has an inner wall formed with two keys each inserted into a respective one of the two opposite keyways of the shaft tube of the first handle.

7. The toilet tank having a two-stage flushing device in accordance with claim 6, wherein the inner wall of the mounting ring of the first link is formed with two elastic snap plates each having a distal end formed with a protruding snap boss snapped into a respective one of the two opposite snap holes of the shaft tube of the first handle, so that the mounting ring of the first link is secured on the shaft tube of the first handle.

8. The toilet tank having a two-stage flushing device in accordance with claim 7, wherein each of the two elastic snap plates of the mounting ring of the first link has two sides each formed with a slits.

9. The toilet tank having a two-stage flushing device in accordance with claim 1, wherein the second end of the second link is formed with a plurality of hanging holes, and the first end of the second lift wire is secured on one of the hanging holes of the second link.

10. The toilet tank having a two-stage flushing device in accordance with claim 1, wherein the first end of the second link is formed with a mounting ring secured on the distal end of the shaft tube of the second handle.

11. The toilet tank having a two-stage flushing device in accordance with claim 10, wherein the distal end of the shaft tube of the second handle has an outer wall formed with two opposite keyways and two opposite snap holes, and the mounting ring of the second link has an inner wall formed with two keys each inserted into a respective one of the two opposite keyways of the shaft tube of the second handle.

12. The toilet tank having a two-stage flushing device in accordance with claim 11, wherein the inner wall of the mounting ring of the second link is formed with two elastic snap plates each having a distal end formed with a protruding snap boss snapped into a respective one of the two opposite snap holes of the shaft tube of the second handle, so that the mounting ring of the second link is secured on the shaft tube of the second handle.

13. The toilet tank having a two-stage flushing device in accordance with claim 12, wherein each of the two elastic snap plates of the mounting ring of the second link has two sides each formed with a slits.

14. The toilet tank having a two-stage flushing device in accordance with claim 1, wherein the connecting seat has a first end formed with a threaded tube extended into the housing and a second end formed with a seat disk rested on the outer side of the housing, and the toilet tank further comprises a locking ring mounted on an inner side of the housing and screwed on the threaded tube of the connecting seat, thereby securing the connecting seat on the housing.

15. The toilet tank having a two-stage flushing device in accordance with claim 14, wherein the connecting seat has a mediate portion formed with a square shaft block located between the threaded tube and the seat disk.

16. The toilet tank having a two-stage flushing device in accordance with claim 15, wherein the shaft block has a square shape.

17. The toilet tank having a two-stage flushing device in accordance with claim 15, wherein the connecting seat includes an elastic washer mounted on the shaft block and rested on the seat disk.

18. The toilet tank having a two-stage flushing device in accordance with claim 14, wherein the seat disk of the connecting seat has a periphery formed with two opposite arcuate limit blocks and two opposite guide slots each located between the two limit blocks, and the shaft tube of the first handle has a second side formed with a limit rib movably mounted in one of the two guide slots and retained by one of the two limit blocks of the seat disk of the connecting seat, so as to limit the rotation angle of the first handle.

19. The toilet tank having a two-stage flushing device in accordance with claim 1, wherein the inside of the housing is provided with an overflow tube.

20. The toilet tank having a two-stage flushing device in accordance with claim 19, wherein the first water outlet tube is located adjacent to the overflow tube, and the second water outlet tube is located adjacent to the overflow tube.

* * * * *